US006089174A

United States Patent [19]

Slikkers et al.

[11] Patent Number: 6,089,174

[45] Date of Patent: Jul. 18, 2000

[54] REMOVABLE PERSONAL WATERCRAFT STORAGE SYSTEM

[75] Inventors: David A. Slikkers, Holland, Mich.; Edward K. Collison, III, Northbrook, Ill.

[73] Assignee: S2 Yachts Inc., Holland, Mich.

[21] Appl. No.: 09/153,000

[22] Filed: Sep. 14, 1998

Related U.S. Application Data

[63] Continuation-in-part of application No. 08/831,135, Apr. 1, 1997, Pat. No. 5,904,113.

[60] Provisional application No. 60/014,581, Apr. 1, 1996.

[51] Int. Cl.[7] ..... B63B 35/40

[52] U.S. Cl. ..... 114/259; 114/343

[58] Field of Search ..... 114/343, 364, 114/258, 259, 260, 261, 262, 344

[56] References Cited

U.S. PATENT DOCUMENTS

| | | | |
|---|---|---|---|
| 2,603,505 | 7/1952 | Arrrowood | 114/344 |
| 3,143,991 | 8/1964 | Anderson . | |
| 3,216,388 | 11/1965 | Smith . | |
| 4,148,465 | 4/1979 | Bowman . | |
| 5,483,912 | 1/1996 | Thomas . | |
| 5,641,242 | 6/1997 | Riviere . | |
| 5,904,113 | 5/1999 | Slikkers | 114/259 |

OTHER PUBLICATIONS

Weaver Industries, Inc. "*The Original Weaver Snap Davits*" brochure.

*Primary Examiner*—Sherman Basinger
*Attorney, Agent, or Firm*—Price, Heneveld, Cooper, Dewitt & Litton

[57] ABSTRACT

A storage system has a relatively unobtrusive mounting plate which is permanently secured to the edge of a vessel's swim platform and removably receives and captively holds a roller assembly. The mounting plate comprises a generally planar rectangular plate configured to conform to the edge shape of the swim platform and includes a generally U-shaped channel extending around the periphery and open at the top to receive the roller assembly. The roller assembly includes a generally rectangular roller supporting plate shaped to fit within the channel of the mounting plate and be captively held therein and a pair of spaced mounting bosses between which there is mounted a roller which extends above the surface of the swim platform for assisting in the loading and unloading of a personal watercraft onto the swim platform. Locking pins extend between the roller plate and the mounting plate for locking the roller assembly in position for use.

21 Claims, 2 Drawing Sheets

REMOVABLE PERSONAL WATERCRAFT STORAGE SYSTEM

CROSS REFERENCE TO RELATED APPLICATIONS

This application is a continuation-in-part of U.S. patent application Ser. No. 08/831,135 filed Apr. 1, 1997, entitled BOAT HAVING A PERSONAL WATERCRAFT SYSTEM, now U.S. Pat. No. 5,904,113, which, in turn, claims the benefit of U.S. Provisional Application Ser. No. 60/014,581, filed Apr. 1, 1996.

BACKGROUND OF THE INVENTION

The present invention relates to a roller storage system for use on a swim platform of a vessel for storing personal watercrafts on the swim platform and particularly one which can be easily removed when not in use.

The popularity of personal watercrafts, such as jet skis and the like, has carried onto owners of larger vessels, who like to take personal watercrafts with them on vacation cruises for recreation and occasional side trips either from an anchorage or from the dock. Conventionally, stern-mounted davits have been used for raising and transporting a dinghy or other personal watercraft behind the stern of a vessel. Other storage systems include hooks which removably clip to an eyelet on the personal watercraft for securing the personal watercraft to the aft edge of the swim platform. The personal watercraft can then be pivoted onto the swim platform and stored against the stern of the vessel for transportation from port to port. Some hooks are available which are removably attached to mounting plates on the swim platform such that when not in use, the swim platform includes only slotted mounting plates on its top surface facing along the stern edge.

Many larger vessels, such as the Tiara® 40 Express, include a relatively large platform having structural support sufficient to easily support personal watercrafts such as jet skis, dinghies and the like. It remains difficult, however, to actually load a personal watercraft onto a swim platform due to the fact that the swim platform typically is from eight to twelve inches above the water level, and it is necessary to lift the personal watercraft onto the swim ladder.

One solution to this problem is a hydraulically operated swim platform which moves vertically, such that can be submerged temporarily for the loading of a personal watercraft and subsequently raised for storage of the watercraft on the swim platform above the water's surface. Although such system provides a solution to the problem of loading and unloading a personal watercraft, as can be appreciated, the structural mechanism for providing a swim platform which moves vertically requires a somewhat expensive hydraulic pump and cylinder system as well as the structural supports allowing for such motion and yet provide sufficient strength to carry the personal watercraft, as well as individuals, on the swim platform.

Another solution is provided by the mounting of a roller assembly on one edge of the swim platform on either the starboard or port side to allow the personal watercraft to be raised and subsequently rolled onto the swim platform assisted, as taught in the above-identified U.S. patent application Ser. No. 08/831,135, filed Apr. 1, 1997, entitled BOAT HAVING A PERSONAL WATERCRAFT SYSTEM, now U.S. Pat. No. 5,904,113, by a winch mounted on the opposite edge of the swim ladder (i.e., the port or starboard side). This structure greatly facilitates the loading and unloading of the personal watercraft to the swim platform, however, there are many occasions when the vessel does not carry the personal watercraft. Thus, it is desirable to be able to remove the additional roller assembly extending laterally from the side of the swim platform, which can interfere with docking of the vessel and can be somewhat less than aesthetically pleasing.

Accordingly, there exists a need for an improved system for loading and unloading person watercrafts onto the swim platform of a vessel and one which is relatively inexpensive, reliable and which can be easily removed for storage when not in use.

SUMMARY OF THE PRESENT INVENTION

The storage system of the present invention provides such a system by providing relatively unobtrusive mounting plates which are permanently secured to the edges of the vessel's swim platform and which receives and captively holds a roller assembly which is removably attached to the mounting plate at one edge of the swim platform and a winch at the other edge of the swim platform. In a preferred embodiment of the invention, each mounting plate comprises a generally planar rectangular plate configured to conform to the edge shape of the swim platform and includes a generally U-shaped channel extending around the lower periphery and open at the top to removably receive the roller assembly therein. The roller assembly comprises a generally rectangular roller supporting plate shaped to fit within the channel of the mounting plate and be captively held therein and a pair of spaced mounting bosses between which there is mounted a roller which extends above the surface of the swim platform for assisting in the loading and unloading of a personal watercraft onto the swim platform. Locking pins are extended between the roller supporting plate and the mounting plate for locking the roller assembly in position on the swim platform for use. In a preferred embodiment also, each roller supporting plate includes sockets for removably receiving a winch assembly such that a personal watercraft can be pulled onto the swim platform from either side as desired.

Thus, the system of the present invention provides a personal watercraft loading mechanism which can be easily removed and stored when not in use to provide flexibility for the vessel owner and use of the system. These and other features, objects and advantages of the present invention will become apparent to those skilled in the art upon reading the following description thereof together with reference to the accompanying drawings.

DETAILED DESCRIPTION OF THE PREFERRED EMBODIMENT

Figure 1:
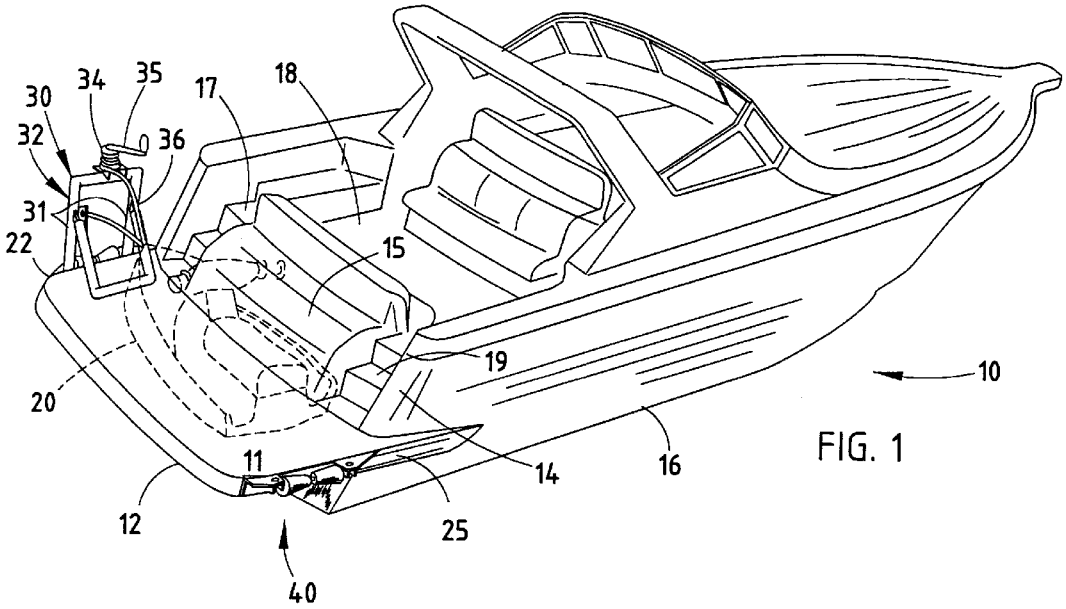
FIG. 1 is a perspective view of a vessel incorporating a personal watercraft mounting system embodying the present invention.

Referring initially to FIG. 1, there is shown a vessel 10, such as a power boat, which integrally includes a swim platform 12 extending from the stern 14 of the vessel. The vessel 10 shown in the preferred embodiment is a Tiara® 40 foot express cruiser which includes a hull 16 to which the swim platform 12 is secured. Access to the swim platform from the cockpit 18 is provided by port and starboard ladders 17 and 19, respectively. The swim platform 12 has a size which extends substantially the width of the stern 14 and has a forward and aft depth sufficient to accommodate a personal watercraft 20 such as a jet ski, shown in phantom form in FIG. 1, or other personal watercraft such as a dinghy, windsurfer, kayaks or the like.

Mounting to the port side of the swim platform along edge 22 thereof is a winch assembly 30, which can be of the construction described in the above-identified U.S. application Ser. No. 08/831,135, filed Apr. 1, 1997, entitled BOAT HAVING A PERSONAL WATERCRAFT SYSTEM, now U.S. Pat. No. 5,904,113, the disclosure of which is incorporated herein by reference. Assembly 30 is preferably removably mounted to the port edge 22 of swim platform 12 utilizing the same mounting plate and support plate roller assembly construction 40 as described below in connection with the removable roller assembly of the present invention. The winch assembly 30 includes a support frame 32 with a pair of spaced-apart vertically extending cylindrical posts 31 which are mounted to the edge of swim platform 12. Assembly 30 includes a winch 34 along a top support member thereof with a line 36 extending therefrom for attachment to a bow cleat of the personal watercraft 20 for assisting in pulling the personal watercraft onto the swim platform. A removable winch handle 35 may be employed with this winch. Mounted to the opposite edge 25 of swim platform 12 is the removable roller assembly 40 of the present invention, which is best seen in the remaining FIGS. 2–4.

Figure 4:
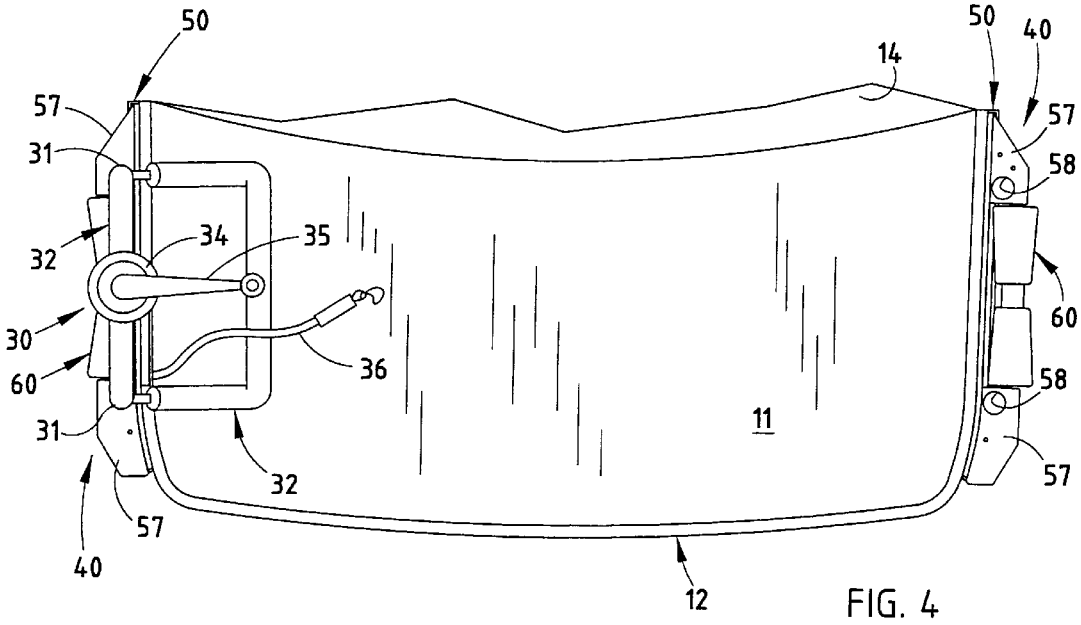
FIG. 4 is a fragmentary top plan view of the swim platform and roller assembly of the present invention.
Figure 2:
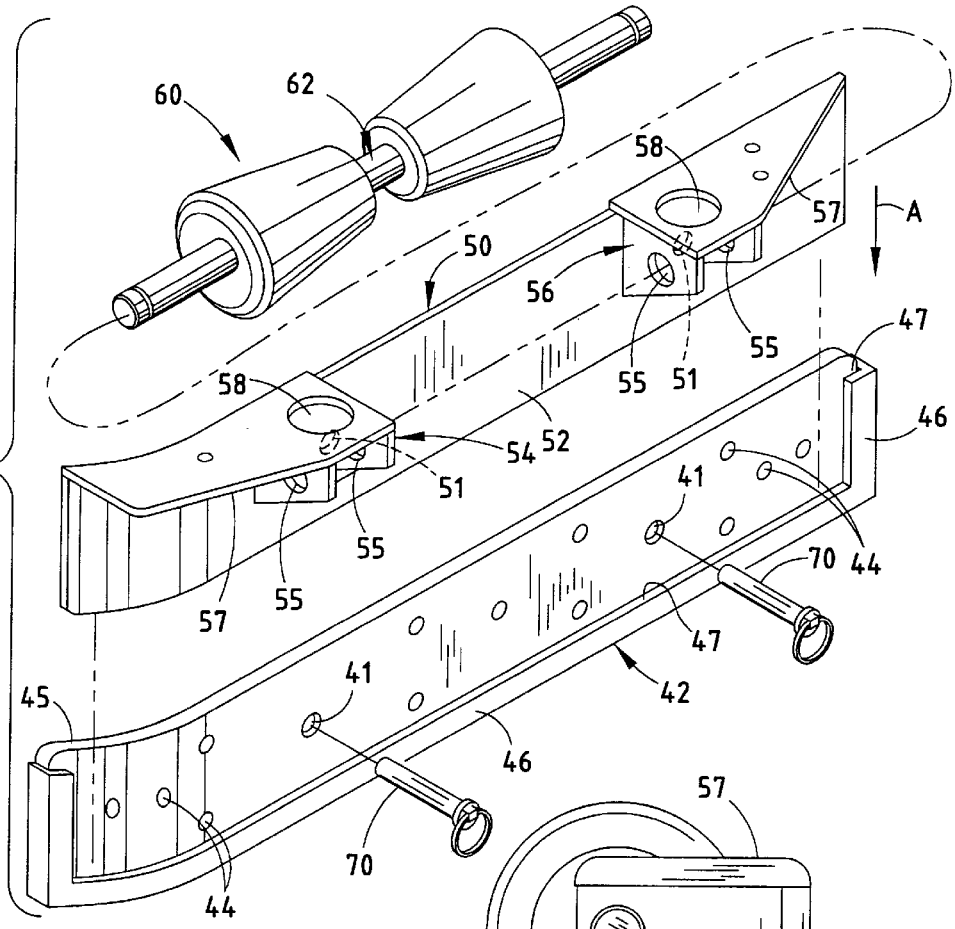
FIG. 2 is an enlarged exploded perspective view of the roller assembly of the present invention.
Figure 3:
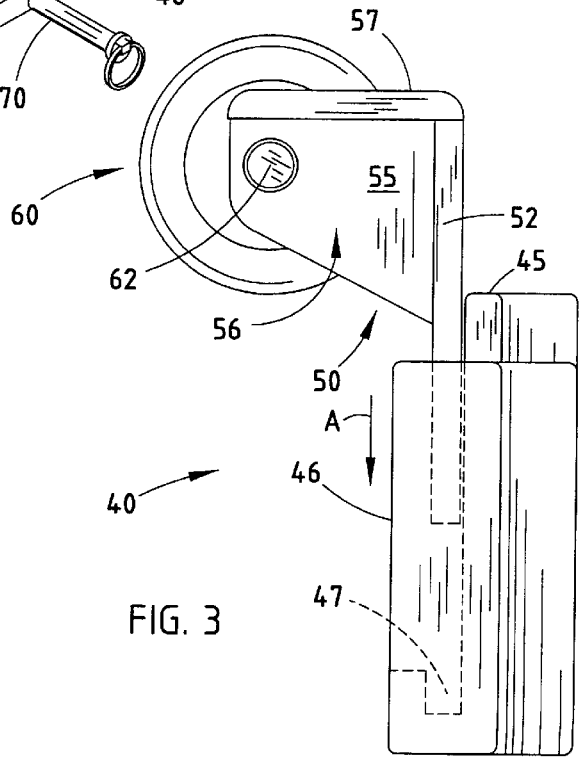
FIG. 3 is an enlarged right end elevational view of the roller assembly of the present invention.

As seen in FIGS. 2–4, the roller assembly 40 comprises a generally rectangular mounting plate 42 which is curved at one end, as seen in FIGS. 2 and 4, to conform to the starboard aft corner of swim platform 12. Plate 42 is relatively unobtrusive when mounted to the edge of the swim platform by a plurality of fastening screws extending through spaced apertures 44 to securely mount the plate to the swim platform. Extending around the bottom and opposite edges of mounting plate 42 is a peripheral lip 46 defining a U-shaped channel 47 therein having a dimension to receive the generally rectangular body 52 of roller mounting plate 50. Mounting plate 42 is made of 316 stainless steel having a thickness of approximately ¼" and fabricated to provide the U-shaped channel 47 which is open along the top 45 of the mounting plate for receiving downwardly therein, as indicated by arrow A in FIGS. 2 and 3, the roller mounting plate 50. The roller mounting plate 50 includes a generally rectangular support plate or body 52 curved to fit within channel 47 of mounting plate 42 and a pair of spaced-apart mounting brackets 54, 56, each of which include spaced-apart vertically extending struts 55 and a horizontally extending trapezoidal plate 57 coupling the struts and defining sockets 58. A roller 60 is secured by an axle 62 between the mounting brackets 54, 56 and extends above the top surface 11 of swim platform 12, when installed as seen in FIG. 1, to provide a roller support for the bottom of a personal watercraft 20 which can be pulled over and onto the swim platform supported by the roller 60 to facilitate loading and unloading of the personal watercraft.

As seen in FIG. 3, one or more push-button type locking pins 70 may be extended between the roller plate 50 and mounting plate 42 for locking the roller plate to the mounting plate through aligned apertures 41 and 51 of the two plates. Plate 50 is also made of 316 stainless steel fabricated as shown in the figures and having a thickness slightly less than the depth of channel 47 of mounting plate 42 such that the roller mounting plate 50 can be easily fitted downwardly into the slot or socket defining channel 47 and captively held therein with the roller 60 extending above the surface 11 of swim platform 12. When inserted, keeper pins 70 are inserted into the mating apertures 41 and 51, respectively, for locking the roller mounting assembly to the mounting plate for use.

When not in use, keeper pins 70 are removed and the roller assembly 40 lifted from mounting bracket 42, leaving the relatively thin, unobtrusive mounting bracket 42 along edge 25 of swim ladder 12. Similarly, a correspondingly shaped mounting bracket 40 is provided for the winch assembly 30 to allow it to also be removably mounted to the swim platform, as seen in FIG. 1. When not in use, winch assembly 30 and roller mounting plates 50 can be stored in the rear storage compartment 15 of the vessel between ladders 17 and 19. Thus, the system of the present invention provides a removable, stowable system for assisting in the loading and unloading of a personal watercraft onto a swim platform of a vessel and one which can be easily stowed when not in use, such that the mechanism does not interfere with either the aesthetics or the normal operation of the vessel in docking and other maneuvers.

It will become apparent to those skilled in the art that various modifications to the preferred embodiment of the invention as described herein can be made without departing from the spirit or scope of the invention as defined by the appended claims.

What is claimed is:

1. A vessel comprising:

a hull having a swim platform extending horizontally from the stem of said vessel;

a removable roller assembly for said swim platform, said assembly including a mounting plate for permanent attachment to an edge of said swim platform, said mounting plate including a guide channel for receiving a roller mounting plate; and a roller mounting plate comprising a generally planar plate configured to fit within said channel of said mounting plate and including a roller rotatably mounted thereto and extending above the surface of said swim platform when said roller mounting plate is inserted into said mounting plate, such that a personal watercraft can be loaded onto said swim platform using said roller assembly.

2. A removable roller assembly for a vessel swim platform comprising:

a mounting plate for permanent attachment to an edge of a swim platform of a vessel, said mounting plate including a guide channel for receiving a roller mounting plate; and a roller mounting plate comprising a generally planar plate configured to fit within said channel of said mounting plate and including a roller rotatably mounted thereto and extending above the surface of a swim platform when said roller mounting plate is inserted into said mounting plate, wherein said roller mounting plate further includes at least one socket for removably receiving a winch assembly.

3. The structure as defined in claim 2 wherein said guide channel of said mounting plate comprises a peripheral channel extending along opposite edges and the bottom of said mounting plate such that it is open along a top edge thereof.

4. The structure as defined in claim 3 and further including locking pins for releasably locking said roller mounting plate to said mounting plate.

5. The structure as defined in claim 4 wherein said mounting plate comprises a stainless steel plate having a curvature to conform to the shape of an edge of a vessel's swim platform.

6. The structure as defined in claim 5 wherein said mounting plate includes a plurality of apertures for securing said mounting plate to a swim platform of a vessel.

7. The structure as defined in claim 6 and further including:

a second mounting plate for permanent attachment to an opposite edge of a swim platform of a vessel, said mounting plate including a guide channel for receiving a roller mounting plate; and a second roller mounting plate comprising a generally planar plate configured to fit within said channel of said mounting plate and including a roller rotatably mounted thereto for extending above the surface of a swim platform when said roller mounting plate is inserted into said mounting plate.

8. The structure as defined in claim 7 and further including a winch assembly for mounting to one of said first and second roller mounting plates.

9. A loading assembly for loading a personal watercraft onto a swim platform of a boat comprising:

a pair of mounting brackets for mounting to each side of a swim platform of a boat, each of said brackets including a vertically extending slot;

a pair of axle support plates removably mounted within said slot of each of said mounting brackets, said axle support plates including an axle and a roller rotatably mounted by said axle to said support plates;

a generally horizontally extending flange extending from a top edge of each of said axle plates away from said swim platform, said flange including at least one socket formed therein for receiving a vertically extending mounting post; and a winch assembly having a vertically extending mounting post for removably mounting said winch assembly in either one of said sockets for assisting in pulling a personal watercraft onto said swim platform from either side of a boat.

10. The loading assembly as defined in claim 9 wherein said roller comprises a single roller having a diameter which is reduced from opposite ends toward the center of said roller to assist in centering a personal watercraft as it is loaded onto the swim platform by said boat loading station.

11. The loading assembly as defined in claim 10 wherein said mounting bracket includes a plurality of apertures for mounting said mounting bracket to a side of the swim platform.

12. The loading assembly as defined in claim 11 and further including a locking mechanism removably extending between each of said mounting brackets and said axle support plate for locking said axle support plate to an associated mounting bracket.

13. The loading ass as defined in claim 12 wherein'said mounting bracket is curved to follow the contour of a swim platform.

14. A loading assembly for loading a personal watercraft onto a vessel swim platform extending horizontally from the stem of the vessel comprising:

a first bracket for mounting on an edge of a swim platform of a vessel, said bracket including a socket with a guide channel for receiving a roller assembly; and a roller assembly removably mounted to said socket, said roller assembly including a roller rotatably mounted thereto and extending above the surface of a swim platform when said roller assembly is inserted into said socket such that a personal watercraft can be loaded onto the swim platform using said roller assembly.

15. The structure as defined in claim 14 wherein said socket is defined by a mounting plate having a peripheral channel extending along opposite edges and the bottom of said mounting plate such that it is open along a top edge thereof.

16. The structure as defined in claim 15 and further including locking pins for releasably locking said roller assembly to said mounting plate.

17. The structure as defined in claim 16 wherein said mounting plate comprises a stainless steel plate having a curvature to conform to the shape of an edge of a vessel's swim platform.

18. The structure as defined in claim 17 wherein said mounting plate includes a plurality of apertures for securing said mounting plate to a swim platform of a vessel.

19. The structure as defined in claim 14 wherein said roller assembly includes a roller mounting plate which further includes at least one second socket for removably receiving a winch assembly.

20. The structure as defined in claim 14 and further including:

a second socket for mounting on an opposite edge of a swim platform of a vessel, said second socket including a guide channel for receiving a second roller assembly; and a second roller assembly removably mounted to said second socket, said second roller assembly including a roller rotatably mounted thereto and extending above the surface of a swim platform when said roller assembly is inserted into said second socket.

21. The structure as defined in claim 20 and further including a winch assembly for mounting to one of said first and second roller assemblies.

* * * * *

UNITED STATES PATENT AND TRADEMARK OFFICE

CERTIFICATE OF CORRECTION

PATENT NO. : 6,089,174
DATED : July 18, 2000
INVENTOR(S) : Slikkers et al.

It is certified that error appears in the above-identified patent and that said Letters Patent is hereby corrected as shown below:

Column 1,
Lines 16, 19, 21, and 38; "watercrafts" should be -- watercraft --.

Column 2,
Line 8; "watercrafts" should be -- watercraft --.
Lines 18, and 19; "receives and captively holds" should be -- receive and captively hold --.

Column 4,
Line 5; after "when" insert -- so --.
Line 33; "stem" should be -- stern --.

Column 5,
Line 8; "claim 6" should be -- claim 2 --.

Column 6,
Line 4; "ass" should be -- assembly --.
Line 9; "stem" should be -- stern --.

Signed and Sealed this

Eighteenth Day of September, 2001

*Attest:*

Nicholas P. Godici

*Attesting Officer*

NICHOLAS P. GODICI
*Acting Director of the United States Patent and Trademark Office*